United States Patent [19]

Gilford et al.

[11] Patent Number: 5,052,052

[45] Date of Patent: Oct. 1, 1991

[54] PROTECTIVE ICE SKATING OUTFIT

[76] Inventors: Katheleen Gilford, 6397 Simler Dr., Clarkston, Mich. 48106; Jean C. Burkart, 2392 Willow La., Highland, Mich. 48031

[21] Appl. No.: 402,639

[22] Filed: Sep. 5, 1989

[51] Int. Cl.[5] ..... A41D 13/00; A41D 11/00; A41D 27/20

[52] U.S. Cl. ..... 2/2; 2/69; 2/250; 2/267

[58] Field of Search ..... 2/69, 267, 24, 23, 22, 2/16, 2, 250, 252

[56] References Cited

U.S. PATENT DOCUMENTS

| | | | |
|---|---|---|---|
| 2,180,346 | 11/1939 | Brewster | 2/70 |
| 2,570,428 | 10/1951 | Clifford | 2/70 |
| 2,629,094 | 2/1953 | Goldsmith | 2/2 |
| 2,724,118 | 11/1955 | Saftlas | 2/70 |
| 3,065,471 | 11/1962 | Leu | 2/267 |
| 3,135,961 | 6/1964 | Roderick | 2/267 |
| 3,248,738 | 5/1966 | Morgan | 2/2 |
| 3,484,868 | 12/1969 | Davenport, Jr. | 2/2 |
| 3,555,567 | 1/1971 | Owen | 2/69.5 |
| 3,670,339 | 6/1972 | Cooper et al. | 2/24 |
| 4,035,844 | 7/1977 | Atack et al. | 2/2 |
| 4,084,264 | 4/1978 | Marion | 2/2 |
| 4,091,466 | 5/1978 | Kearn | 2/24 |
| 4,128,902 | 12/1978 | Siebert | 2/2 |
| 4,325,148 | 4/1982 | Livernois | 2/2 |
| 4,441,211 | 4/1984 | Donzis | 2/69 |
| 4,507,801 | 4/1985 | Kavanagh et al. | 2/2 |
| 4,513,451 | 4/1985 | Brown | 2/69 |
| 4,561,123 | 12/1985 | Hull | 2/24 |
| 4,561,124 | 12/1985 | Thompson | 2/23 |
| 4,613,991 | 9/1986 | Grover | 2/23 |
| 4,627,111 | 12/1986 | Storie | 2/69 |
| 4,688,269 | 8/1987 | Maeshima | 2/24 |
| 4,756,026 | 7/1988 | Pierce, Jr. | 2/24 |
| 4,831,666 | 5/1989 | Denman | 2/24 |
| 4,920,577 | 5/1990 | Scharf | 2/22 |

FOREIGN PATENT DOCUMENTS

| | | | |
|---|---|---|---|
| 2082043 | 3/1982 | United Kingdom | 2/24 |

*Primary Examiner*—William A. Cuchlinski, Jr.
*Assistant Examiner*—C. W. Fulton
*Attorney, Agent, or Firm*—Lynn E. Cargill

[57] ABSTRACT

A protective suite to protect a skater against injuries caused by falling during skating which has interior flap-type pockets designed to hold removable compressible padding inserts at areas susceptible to falling injuries. The pockets have a pocket body and an opening and are attached to the suit while inverted so that the opening is exposed to receive a compressible padding insert such that, when the pocket is flipped down, the pocket openign is between the pocket body and the portion of the suit to which the pocket is attached, thereby holding the compressible insert therein without allowing the compressible insert to slip upward and out of the pocket, yet allowing for removal of the compressible insert so that the protective suit may be washed without the insert in place.

11 Claims, 3 Drawing Sheets

FIG 1
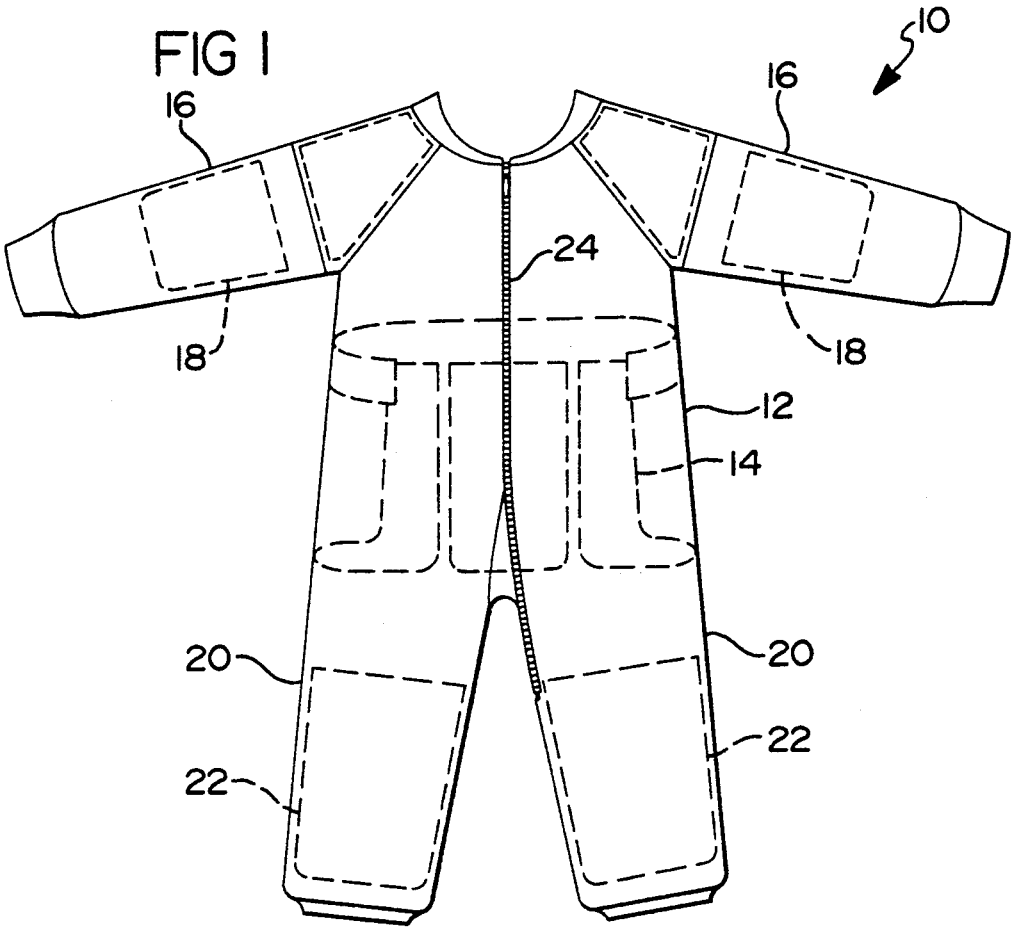
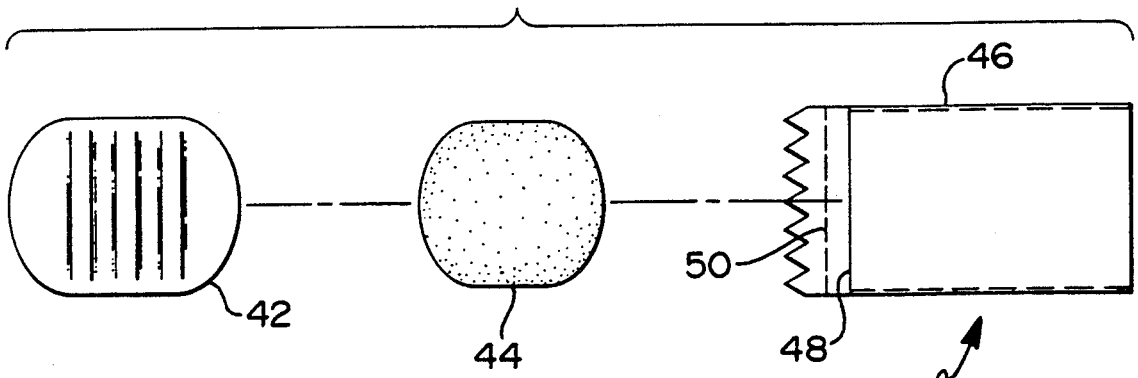
FIG 2

FIG 3
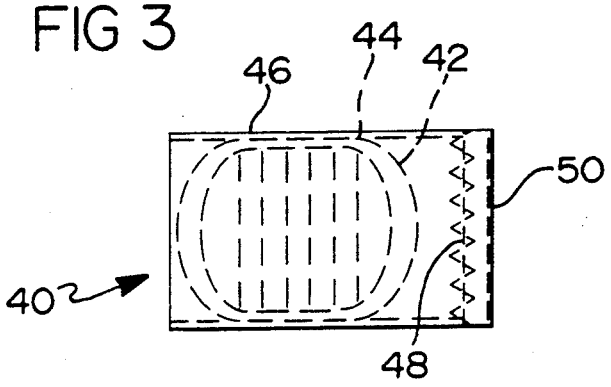
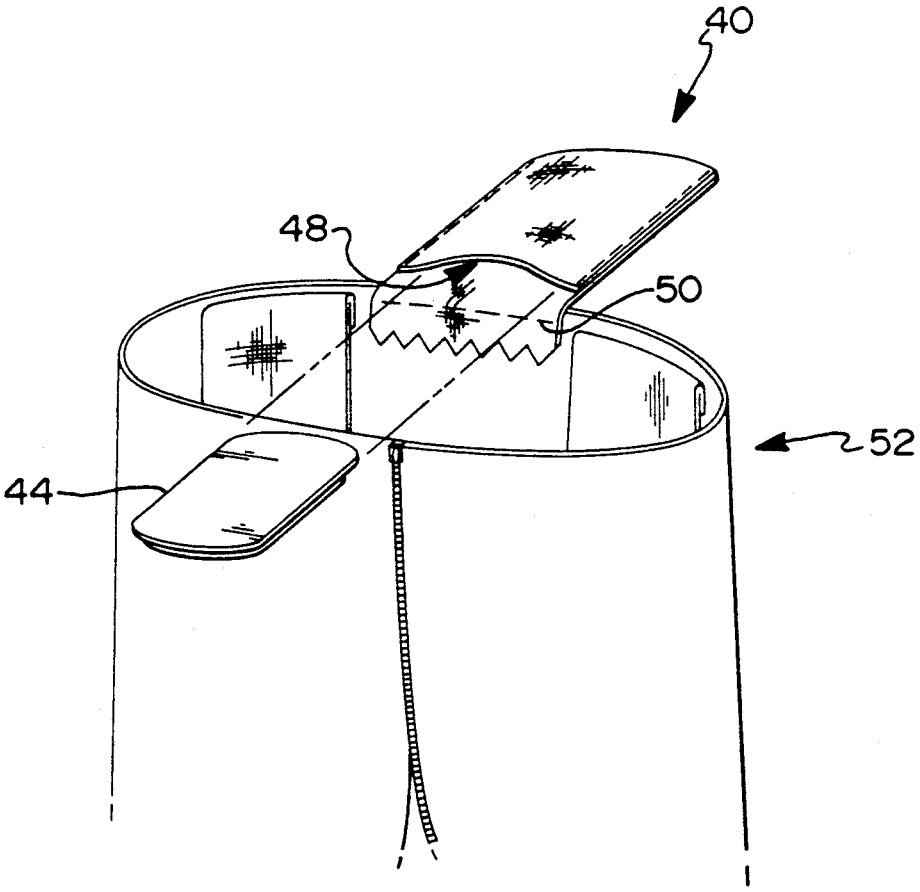
FIG 4

PROTECTIVE ICE SKATING OUTFIT

TECHNICAL FIELD

This invention relates generally to padded suits, and more particularly relates to suits padded to prevent injuries caused by falling, e.g., during skating.

BACKGROUND OF THE INVENTION

Traditional protective suits made for playing hockey have protective padding covering substantially the entire body to protect the wearer primarily against flying hockey pucks and swinging hockey sticks. The padding of these suits is extremely bulky and inflexible causing the suit to be heavy, hot to wear and quite expensive. Often the hockey padding is attached to the body by wrapping padding pieces with tape. This procedure is a cumbersome, time-consuming operation, making the suit difficult to put on and take off. In addition, when the wrapping procedure is used, the protective suit is in several pieces, making the suit susceptible to forgotten or misplaced pieces of equipment.

Specific disclosures of protective clothing can be found in U.S. Pat. Nos. 3,248,738, 3,484,868, 4,035,844, and 4,084,264. U.S. Pat. No. 3,248,738 issued to Morgan on May 3, 1966 relates to protective padding structures characterized by interior portions formed of porous resilient material. These interior portions are all at least partially surrounded by a resilient, essentially air-impervious barrier. The padding construction disclosed is used in conjunction with relatively rigid surfaces disposed on the opposite sides of the porous interior.

U.S. Pat. No. 3,484,868, issued to Davenport on Dec. 23, 1969, discloses an athletic pad having a retaining plate attached to one side with slots in the retaining plate slidably mounting male snap connector members connectable to female members on an elastic portion of an athletic uniform so that stretching of the elastic portion is enabled by sliding movement of the male connectors in their support slots.

U.S. Pat. No. 4,035,844 issued to Atack on July 19, 1977, discloses a trouser-like article of clothing which combines the functions of underwear, socks, garter belts and crotch protector, which may be worn under conventional sporting clothing, e.g. hockey pants. The article of clothing has auxiliary pockets provided at the knees and thighs for the insertion of additional padding, if desired. The knee and thigh pockets are stitched on three sides with the top being open to permit the insertion of the padding.

U.S. Pat. No. 4,084,264 issued Apr. 18, 1978, discloses a batting jacket having a batting side and a non-batting side. The material of construction is of a quilted nature in the protected area and is non-quilted, relatively thin fabric in the non-protective area.

In beginners' ice or roller skating, or in children's hockey, where pylons or cones are pushed around instead of pucks, the greatest danger to the skater is injury caused by falling. Beginner skaters and hockey players, therefore, do not require the excessive padding of the traditional hockey suits with its associated problems. A skating suit with all the padding inserted therein would also have the advantage of helping the mothers and caretakers of the skaters to remember all the pieces of their suits, as it is a common problem to forget some of the multitude of pieces generally associated with traditional skating suits. In addition, young children between the ages of 2 to 6 have no desire to emulate adult hockey players with the excessive padding. There is, therefore, a need for a protective suit designed for beginner skaters which does not have the excessive padding of the traditional hockey suit, yet protects the wearer against falling injuries.

In addition, often, young children have not yet developed the discipline to hold urges to urinate. Therefore, a suit which is easy to put on and take off is desired by the mothers and caretakers of these young skaters so that the suit can be removed at a moment's notice in the bathroom. Furthermore, as children are often known to dirty their clothing, a washable protective suit is highly desired.

It is an object of this invention to provide a protective suit designed especially for toddlers or juniors which has minimal padding but protects against falling injuries which is easy to put on easy to take off and is washable.

SUMMARY OF THE INVENTION

In accordance with the preferred embodiment of the invention, these and other objects and advantages are addressed as follows. A protective suit capable of protecting beginner skaters from injuries is disclosed which is non-bulky, light-weight, easy to put on and take-off, has a minimum of pieces, and is designed with removable padding to allow for removal of the padding for washing. The suit has a torso portion having a tailbone area, two sleeves, each having an elbow area, and two pant legs, each having a knee area, and has hanging flap-type interior pockets with padding protecting the areas susceptible to falling injuries. Each such pocket has a pocket body and an opening and is attached to the suit while inverted so that the opening is exposed to receive a compressible padding insert such that when the pocket is flipped down, the pocket opening is between the pocket body and the portion of the suit to which the pocket is attached, thereby holding the compressible padding insert therein without allowing it to slip upward and out of the pocket, yet allowing for removal of the compressible insert so that the protective suit may be washed without the insert in place.

Preferably, the interior pockets are located at the elbow, the front of the knee, and the tailbone areas, and hard guard pieces are attached to the compressible inserts which are designed to be placed in the pockets intended for the elbow and tailbone areas. Disclosed are one-piece and two-piece suits each having releasably engageable closure means on the suit for fastening and unfastening the suit in one quick movement.

BRIEF DESCRIPTION OF THE DRAWINGS

The nature and extent of the present invention will be clear from the following detailed description of the particular embodiments thereof, taken in conjunction with the appendant drawings, in which:

FIG. 1 shows a front plan view of a one-piece protective skating suit constructed in accordance with the present invention;

FIG. 2 shows an exploded view of the disclosed hanging flap-type pocket in the flipped-open position showing the relative placement of the compressible padding insert and the hard guard piece;

FIG. 3 shows a front plan view of the disclosed hanging flap-type pocket in the closed position showing the compressible padding insert and the hard guard piece both in position in phantom;

FIG. 4 illustrates a pant leg portion of a protective suit of the invention showing, in perspective, a flap-type pocket at the tailbone area in a flipped-open position.

DETAILED DESCRIPTION OF THE INVENTION

Figure 5:
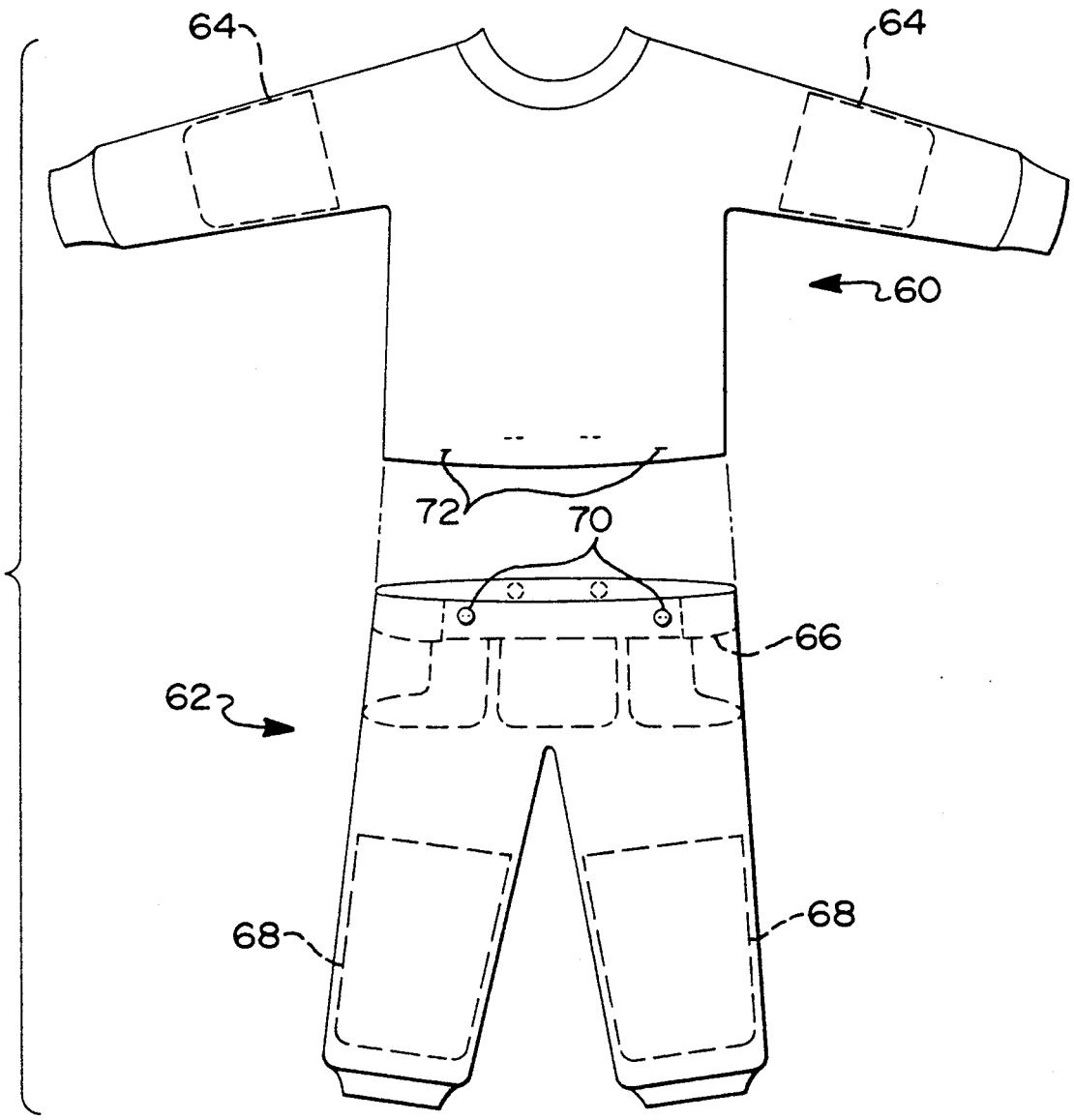
FIG. 5 is a front plan view of a protective two-piece suit constructed in accordance with the present invention.

Referring first to FIG. 1, one-piece protective skating suit 10 has torso portion 12 having a tailbone area designated generally by broken lines 14, two sleeves 16 having elbow areas designated generally by broken lines 18, and two pant legs 20 having knee areas generally designated by broken lines 22. Suit 10 is designed to have padding in the areas that are most susceptible to falling injuries, i.e. at the tailbone, elbows, and knees. In these susceptible areas, suit 10 has interior flap-type pockets which are designed to hold compressible inserts, such as padding made of foam rubber.

The pockets are sewn into the interior of suit 10 at areas 14, 18 and 22 in such a way so as to securely hold removable compressible inserts therein. The pockets are best exemplified by pocket 40 which is shown in FIG. 2. Pocket 40, hard guard piece 42, and compressible insert 44 are shown in exploded view in FIG. 2. Pocket 40 includes pocket body 46 and pocket opening 48, and is sewn to the inside of suit 10 as shown by seam 50. Pocket 40 is shown in the flipped-open position ready to accept compressible insert 44 and hard guard piece 42. For the pockets at the elbows and the tailbone areas ,a compressible insert is attached to a hard guard piece for added protection. At the knees and at any other optional area, such as at the shoulders, typically only the compressible insert is needed. The compressible inserts and hard guard pieces are generally sized and shaped to match the corresponding anatomical contour.

After insertion of compressible insert 44 and hard guard piece 42 or compressible insert 44 only, pocket 40 is flipped over so as to close pocket opening 48, as shown in FIG. 3, thus, not allowing the contents to slip out. In this design, however, compressible insert 44 and hard guard piece 42 are easily removed from pocket 40 to allow for machine washing of the suit.

Returning to FIG. 1, protective suit 10 has zipper 24 extending from the neck to the crotch of suit 10. Other releasably engageable closure means may, of course, be used, e.g. the interengageable fasteners known by the trademark of VELCRO. The zipper or similar means on suit 10 provides a way for fastening and unfastening the suit in one quick movement, making the suit easy to put on and take off.

FIG. 4 shows a pant portion 52 having pocket 40 stitched to the inside of the suit at 50. Pocket 40 is shown in the flipped-open position exposing opening 48. Compressible padding insert 44 is shown outside pocket 40 with dashed lines indicating its proper placement in pocket 40.

FIG. 5 illustrates a two-piece protective suit constructed according to the invention in a similar fashion as one-piece suit 10 of FIG. 1. The two-piece suit is shown having shirt piece 60 including elbow areas designated by broken lines 64 and pant piece 62 having tailbone area designated by broken lines 66 and knee areas designated by broken lines 68. Pant piece 62 has a closure means which may include snaps, buttons, suspenders or any other conventional means of closure. Buttons 70 are shown at the waist corresponding to button holes 72 in shirt piece 60, providing a means for quickly fastening and unfastening the two-pieces. Broken lines 64, 66, and 68 of the two-piece protective suit designates the placement of hanging flap-type interior pockets described earlier and shown in FIG. 2. This type of suit is especially useful for slightly older figure skaters.

The protective suits of this invention are preferably made of light-weight washable stretch fabric, e.g. polyester. The compressible inserts are preferably formed of foamed material made of polymers selected from the group consisting of neoprene/ethylene propylene terpolymer/styrene-butadiene rubber, neoprene, nitrile, epichlorohydrin, ethylene propylene terpolymer, vinyl/nitrile, styrene-butadiene rubber/vinyl, ethylene propylene terpolymer/polyethylene/butyl, styrene-butadiene rubber, ethylene vinyl acetate, and chlorinated polyethylene. These polymers are available from Rubatex Corporation, Bedford, Va. The hard guard pieces may be formed of polyolefin plastic, e.g. ultra-high molecular weight (UHMW) polyethylene, and the polyolefin plastic pieces may be attached to the foam rubber pieces, e.g., by gluing with RUBATEX adhesives, also available from Rubatex Corporation, Bedford, Va.

In an alternative suit design for a figure skater, the suits as shown in FIGS. 1 and 3 can be worn with pullover skirts or tunics or the suits may have tunics or skirts sewn to them.

Thus, there is provided in accordance with the present invention, a non-bulky, light-weight, protective skater's suit which protects skaters from falling injuries that is easy to don and easy to take-off. In addition, the suit is designed so that only underwear needs to be worn under the suit. The suit is especially beneficial for young children because it is made with a minimum of pieces (one or two-piece) and is designed to securely hold padding and yet allow for easy removal of the padding for washing.

While our invention has been described in terms of a specific embodiment, it must be appreciated that other embodiments could readily be adapted by one skilled in the art. Accordingly, the scope of our invention is to be limited only by the following claims.

We claim:

1. A protective skating suit designed to hold removable compressible padding inserts in individual pockets for protecting a skater against injuries caused by falling during skating, comprising:

a torso portion having a tailbone area;

two sleeves, each having an elbow area; and two pant legs, each having a knee area;

said suit having non-integral, individual hanging flap-type interior pockets, said interior pockets being located at the elbow areas, the front of the knee areas, and the tailbone area, and each pocket having a pocket body and an opening for holding the removable compressible padding inserts within said pockets, and each pocket being attached to the suit while inverted and in an upside down position so that the opening is exposed while in the upside down position to receive one of the compressible padding inserts, such that when the pocket is flipped down the padding is enclosed on all sides by the pocket material and thereby secured in place, the pocket opening being between the pocket body and the portion of the suit to which the pocket is attached, thereby holding the compressible padding insert therein without allowing the compressible padding insert to slip upward and out of the pocket, yet allowing for removal of the compressible padding insert so that the protective suit may be washed without the insert in place.

2. The protective suit of claim 1 further comprising hard guard pieces formed of polyolefin plastic attached to said compressible padding inserts designed to be placed in the pockets intended for the elbow and tailbone areas.

3. A protective one-piece skating suit designed to hold removable compressible padding inserts in individual pockets for protecting a skater against injuries caused by falling during skating, comprising:

a torso portion having a tailbone area, two sleeves, each having an elbow area, two pant legs, each having a knee area, and releasable engageable closure means on said suit for fastening and unfastening said suit in one quick movement, said suit having non-integral, individual hanging flap-type interior pockets, said interior pockets being located at the elbow areas, the front of the knee areas, and the tailbone area, and each pocket having a pocket body and an opening for holding the removable compressible padding inserts within said pockets, and each pocket being attached to the suit while inverted and in an upside down position so that the opening is exposed while in the upside down position to receive one of the compressible padding inserts, such that when the pocket is flipped down the padding is enclosed on all sides by the pocket material and thereby secured in place, the pocket opening being between the pocket body and the portion of the suit to which the pocket is attached, thereby holding the compressible padding insert therein without allowing the compressible padding insert to slip upward and out of the pocket, yet allowing for removal of the compressible padding insert so that the protective suit may be washed without the insert in place.

4. The protective one-piece suit as in claim 3, wherein said suit is made of washable material.

5. The protective one-piece suit of claim 3, wherein said closure means is a zipper extending from the neck of the suit to the crotch.

6. The protective suit of claim 3 further comprising hard guard pieces formed of polyolefin plastic attached to said compressible padding inserts designed to be placed in the pockets intended for the elbow and tailbone areas.

7. A protective two-piece skating suit designed to hold removable compressible padding inserts for protecting a skater against injuries caused by falling during skating, comprising:

a shirt piece having two elbow areas, a pant piece having a tailbone area and two knee areas, and releasable engageable closure means on said suit for fastening and unfastening said pieces in one quick movement, said suit having non-integral, individual hanging flap-type interior pockets, said interior pockets being located at the elbow areas, the front of the knee areas, and the tailbone area, and each pocket having a pocket body and an opening for holding the removable compressible padding inserts within said pockets, and each pocket being attached to the suit while inverted and in an upside down position so that the opening is exposed while in the upside down position to receive one of the compressible padding inserts, such that when the pocket is flipped down the padding is enclosed on all sides by the pocket material and thereby secured in place, the pocket opening being between the pocket body and the portion of the suit to which the pocket is attached, thereby holding the compressible padding insert therein without allowing the compressible padding insert to slip upward and out of the pocket, yet allowing for removal of the compressible padding insert so that the protective suit may be washed without the insert in place.

8. The protective suit as in claim 7 wherein said suit is made of washable material.

9. The protective suit of claim 7 wherein said closure means consists of buttons and corresponding button holes.

10. The protective suit of claim 7 further comprising hard guard pieces formed of polyolefin plastic attached to said compressible padding inserts designed to be placed in the pockets intended for the elbow and tailbone areas.

11. A one-piece washable protective skating suit designed to hold removable compressible padding inserts in individual pockets for protecting a skater against injuries caused by falling during skating, comprising:

a torso portion having a tailbone area;

two sleeves, each having an elbow area;

two pant legs, each having a knee area;

releasable-engageable closure means on said suit for fastening and unfastening said suit in one quick movement;

non-integral, individual hanging flap-type interior pockets attached to said suit located at said tailbone area, at said elbow areas, and at the front of said knee areas, each pocket having a pocket body and an opening, and each pocket being attached to the suit while inverted and in an upside down position so that the opening is exposed while in the upside down position to receive one of the compressible padding inserts, such that when the pocket is flipped down the padding is enclosed on all sides by the pocket material and thereby secured in place, the pocket opening being between the pocket body and the portion of the suit to which the pocket is attached, thereby holding the compressible padding insert therein without allowing the compressible padding insert to slip upward and out of the pocket, yet allowing for removal of the compressible padding insert so that the protective suit may be washed without the insert in place;

removable compressible padding inserts for placement within said pockets; and hard guard pieces attached to said compressible padding inserts for the elbow and tailbone areas.

* * * * *